US008991575B2

(12) United States Patent
Nebeling

(10) Patent No.: US 8,991,575 B2
(45) Date of Patent: Mar. 31, 2015

(54) LUGGAGE WITH SUPPORT RECEPTACLE

(71) Applicant: Thomas Nebeling, New York, NY (US)

(72) Inventor: Thomas Nebeling, New York, NY (US)

( * ) Notice: Subject to any disclaimer, the term of this patent is extended or adjusted under 35 U.S.C. 154(b) by 0 days.

(21) Appl. No.: 13/777,622

(22) Filed: Feb. 26, 2013

(65) Prior Publication Data

US 2014/0238800 A1 Aug. 28, 2014

(51) Int. Cl.
*A45C 13/00* (2006.01)

(52) U.S. Cl.
CPC ..... *A45C 13/001* (2013.01)
USPC ..... 190/102; 190/111

(58) Field of Classification Search
CPC ..... A45C 13/001
USPC ..... 190/1, 39, 102, 18 R, 111
See application file for complete search history.

(56) References Cited

U.S. PATENT DOCUMENTS

| | | | | | |
|---|---|---|---|---|---|
| 294,260 | A * | 2/1884 | Niles | 190/3 |
| 1,062,578 | A * | 5/1913 | Axford | 190/102 |
| 2,413,830 | A * | 1/1947 | Janosz | 190/102 |
| 3,219,400 | A * | 11/1965 | Bergquist | 312/107 |
| 5,115,893 | A * | 5/1992 | Terkildsen | 190/11 |
| 5,533,601 | A * | 7/1996 | Wang | 190/115 |
| 5,950,779 | A * | 9/1999 | Miyoshi | 190/18 A |
| 6,305,514 | B1 * | 10/2001 | Lin et al. | 190/115 |
| 6,367,603 | B1 * | 4/2002 | Tiramani et al. | 190/100 |
| 6,609,599 | B1 * | 8/2003 | Chang | 190/115 |
| 6,672,440 | B2 * | 1/2004 | Lin et al. | 190/115 |
| 6,769,588 | B2 * | 8/2004 | Zheng | 224/576 |
| 2003/0000785 | A1 * | 1/2003 | Miller et al. | 190/115 |

* cited by examiner

*Primary Examiner* — Sue A Weaver
(74) *Attorney, Agent, or Firm* — Malina & Associates, PLLC

(57) ABSTRACT

Luggage includes an upper panel portion which has a receptacle. The receptacle enables a user to insert a portion of a tablet computer into the receptacle and the receptacle retains the tablet computer at a convenient angle for operation.

3 Claims, 13 Drawing Sheets

LUGGAGE WITH SUPPORT RECEPTACLE

FIELD OF THE INVENTION

The present invention relates generally to the field of luggage and more particularly to luggage with a support receptacle.

BACKGROUND OF THE INVENTION

Recent advances in the field of computers have led to the increased popularity of extremely compact and portable computers of the type generally known as tablet computers. Travellers wishing to utilize tablet computers often find that the use of such computers leads to a degree of awkwardness resulting from a need to hold the tablet computer to utilize the touch screen while maintaining proper control over their luggage.

OBJECTS AND SUMMARY OF THE INVENTION

It is an object of the present invention to provide luggage with a support receptacle which can be utilized by a traveller to support a tablet computer while providing convenient and ergonomic access to the touch screen.

Another object of the present invention is to provide luggage with a support receptacle which does not interfere or detract from the storage capacity of the luggage.

Another object of the present invention to provide luggage with a support receptacle which can easily utilized to support a tablet computer in both portrait and landscape orientations.

Yet another object of the present invention to provide luggage with a support receptacle which is reliable in operation and economical to manufacture resulting in a relatively low unit cost.

Other objects and advantages of the present invention will be made clear hereinafter.

In accordance with the present invention there is provided luggage with a support receptacle which may be used by a traveller to support a tablet computer.

In the primary embodiment of the invention, the receptacle is formed as a unitary member which is mounted in a slot which is formed on the top panel portion of the luggage. The receptacle incorporates a backrest portion which includes a pair of rubber pads. The backrest portion forms an angle with the generally horizontal plane of the top panel portion of the luggage. This angle provides comfortable viewing and operation of the tablet touch screen. The lower portion of the backrest portion leads to a smooth continuous curved surface which forms the bottom portion of the receptacle. This curved portion enables the bottom of the tablet computer to lodge in the receptacle in a secure manner.

The second embodiment of the invention is generally similar to the first embodiment with the exception that the second embodiment includes a door panel. The door panel may be opened to reveal the receptacle. A latch holds the door panel in the looked position when not in use. When closed, the door panel provides a smooth appearance for the luggage.

BRIEF DESCRIPTION OF THE DRAWINGS

Additional details of construction of the invention will be described with reference to the drawings in which.

DETAILED DESCRIPTION OF THE INVENTION

Figure 1:
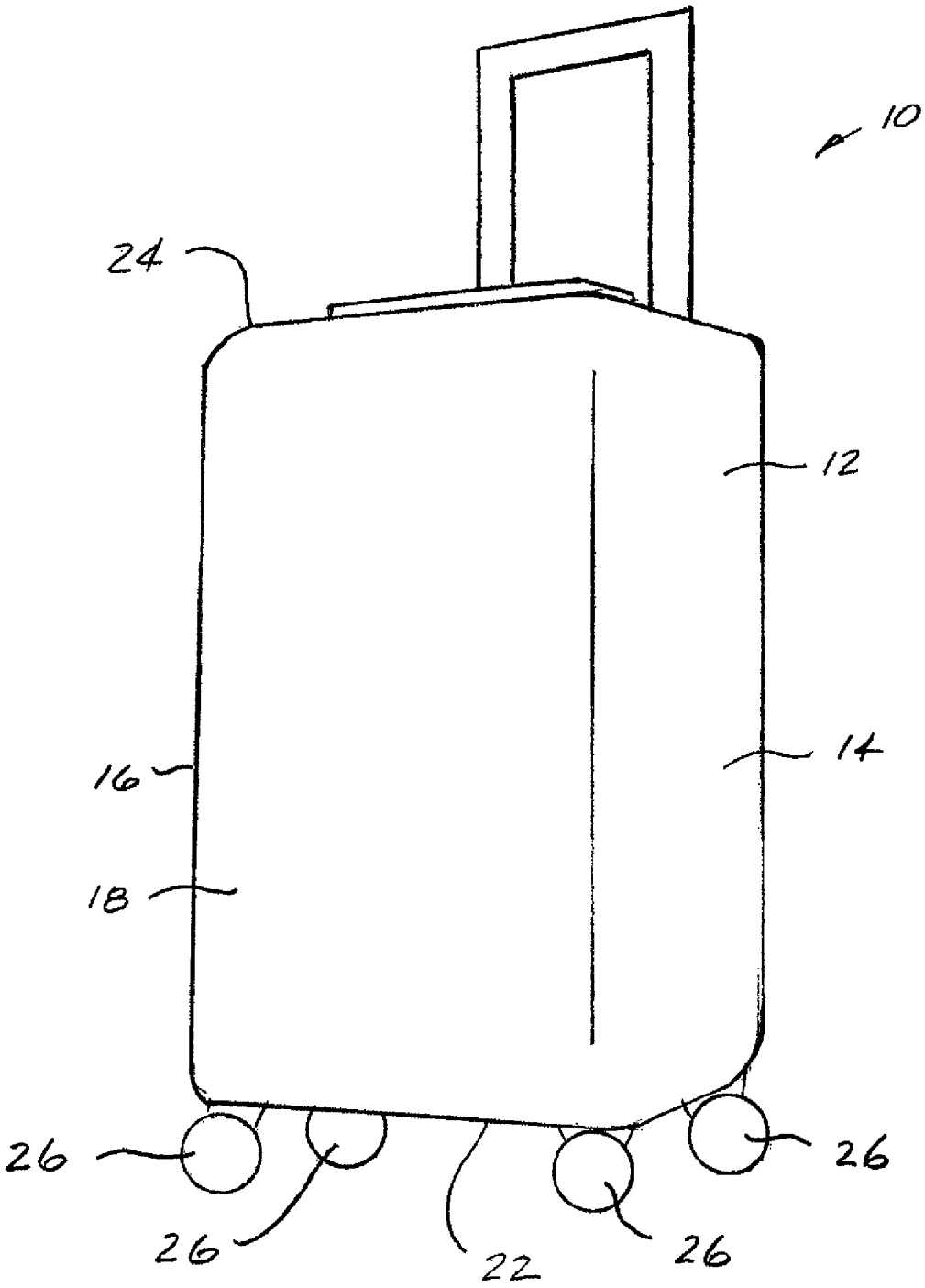
FIG. 1 is an overall perspective view of luggage with a support receptacle made according to the present invention.

With reference to the drawings there is shown in FIGS. 1-13 luggage with a support receptacle 10 made accordance with the present invention. The primary embodiment of the invention is shown in FIGS. 1-9.

The luggage with a support receptacle 10 includes a luggage assembly 12 which is illustrated by way of example as a hard sided luggage assembly 12 which includes side panel portions 14, 16, front 18 and rear panel portions 20, a bottom 22 and a top 24, wheels 26, a conventional handle 28, and a telescoping handle 30.

A key feature of the present invention is the receptacle 32 which is mounted on the top panel portion 24 of the luggage assembly 12.

Other elements of the luggage assembly 12 are conventional in nature and therefore need not be described in detail.

Figure 2:
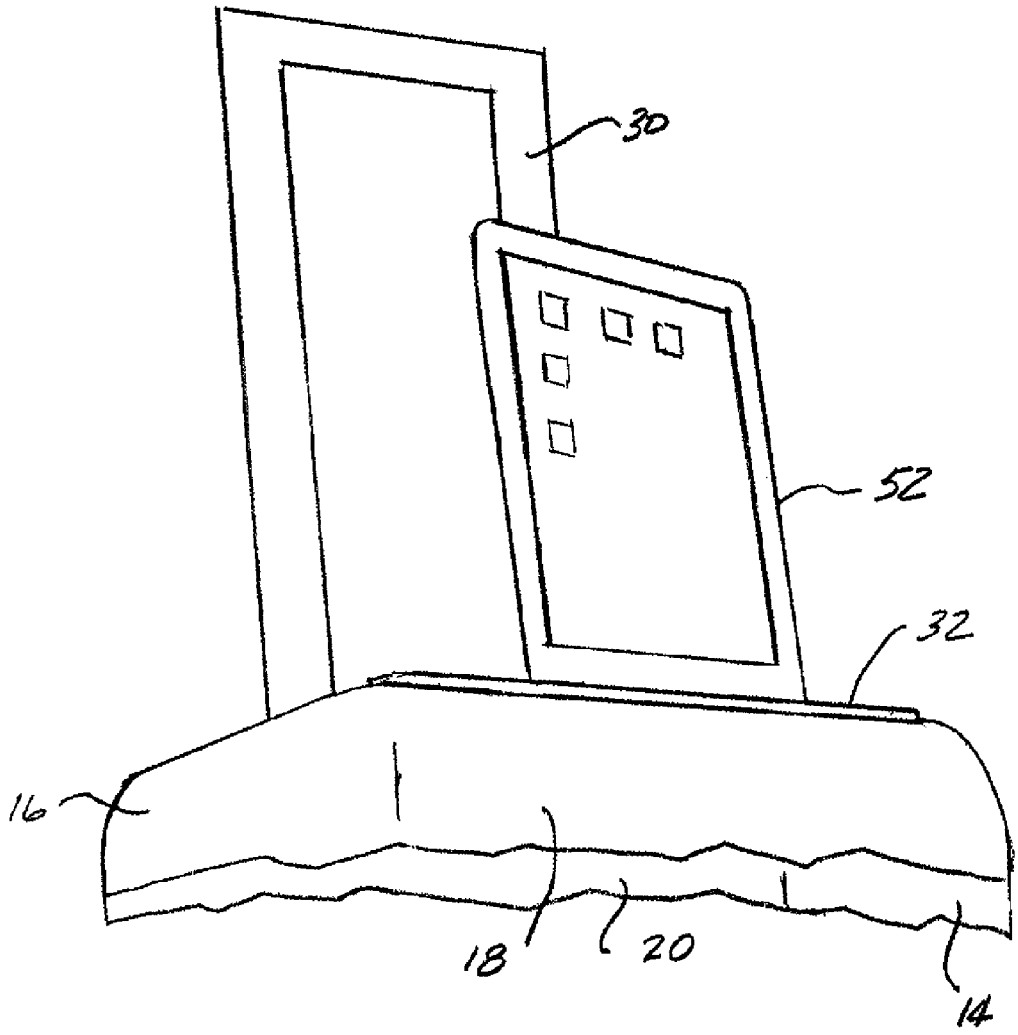
FIG. 2 is a fragmentary perspective view of luggage with a support receptacle showing the invention in use supporting a tablet computer.
Figure 3:
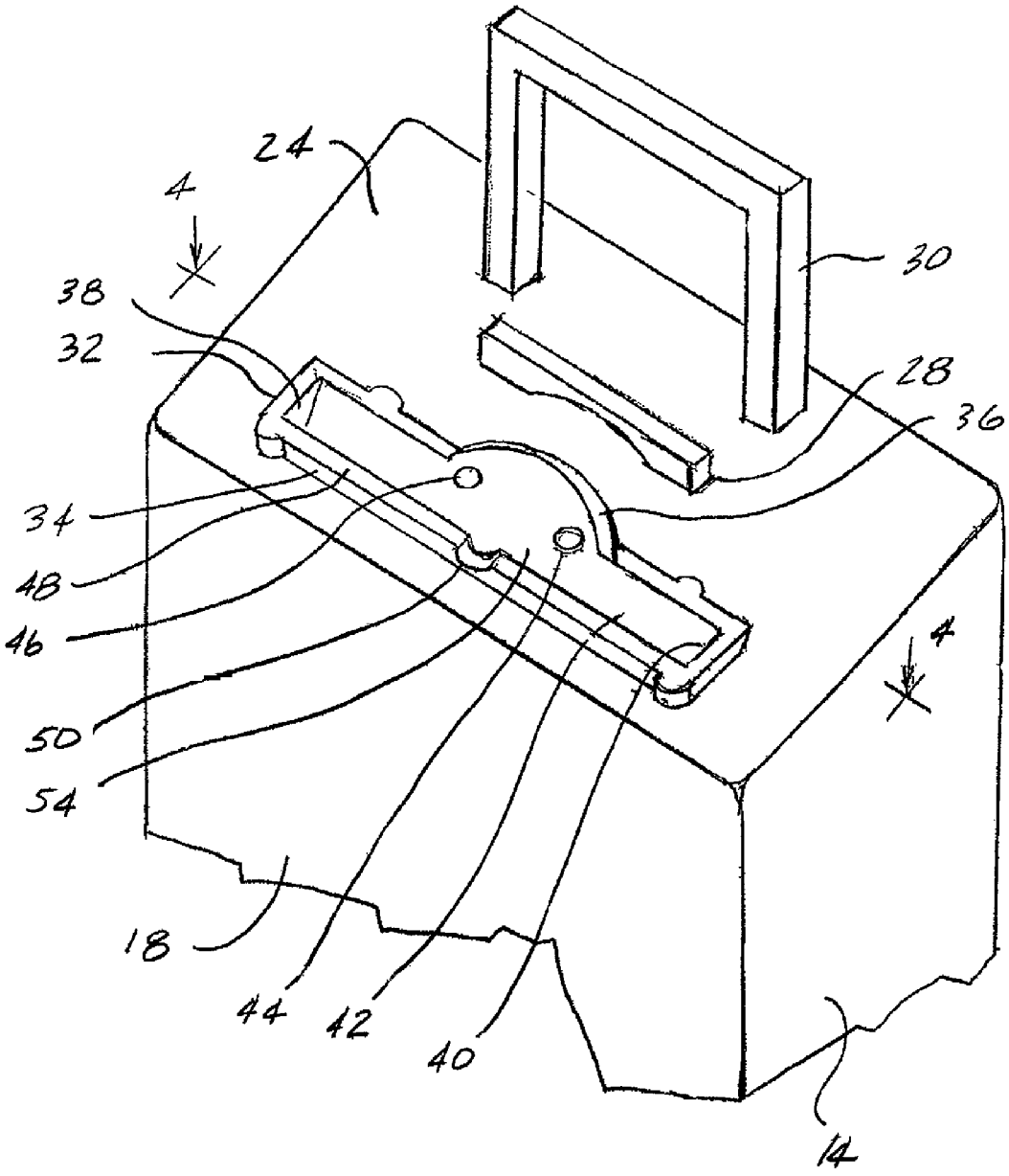
FIG. 3 is a fragmentary to view of luggage with a support receptacle showing the receptacle mounted on the top panel portion of the luggage.
Figure 6:
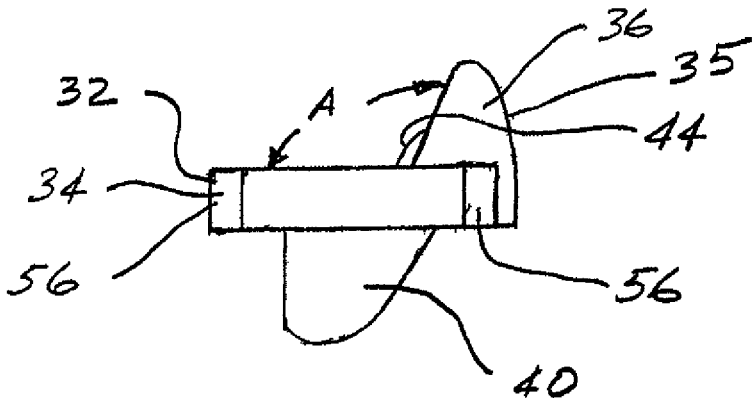
FIG. 6 is an end view of the receptacle taken along the line 6-6 of FIG. 5.
Figure 7:
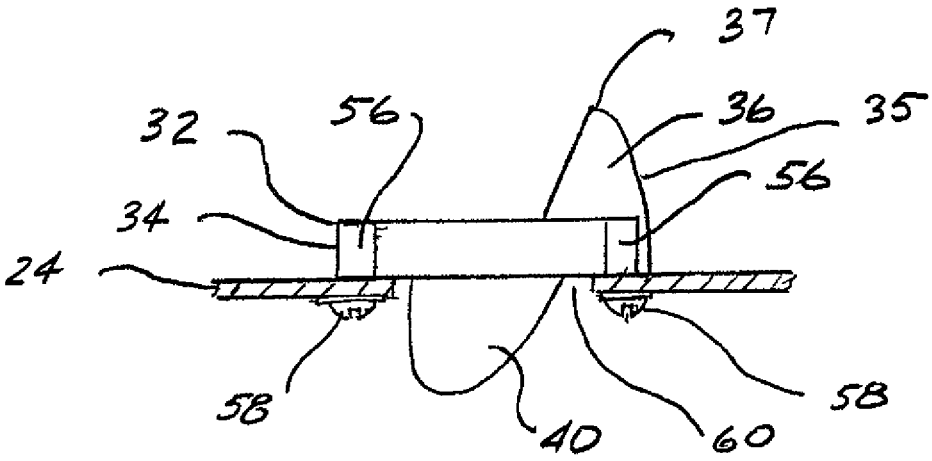
FIG. 7 is an end view of the receptacle similar to FIG. 6 showing the receptacle mounted on the top panel portion of the luggage.
Figure 8:
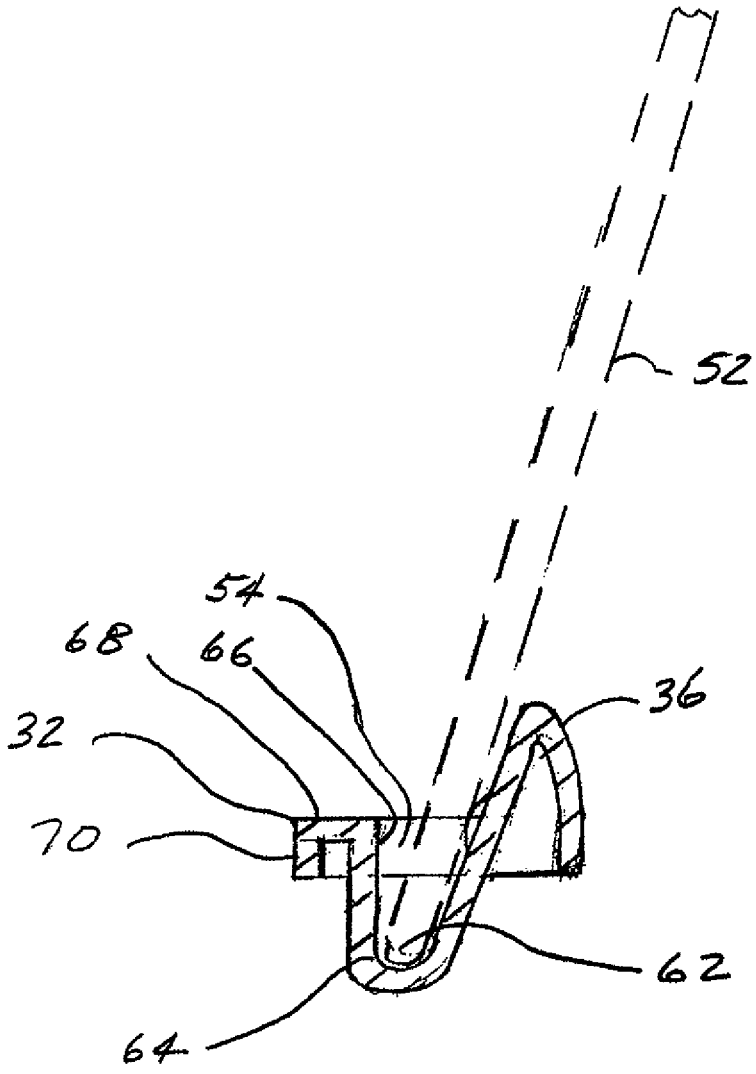
FIG. 8 is a cross-sectional view of the receptacle taken along the line 8-8 of FIG. 4 showing the receptacle supporting a tablet computer, with the tablet computer shown in broken lines.
Figure 9:
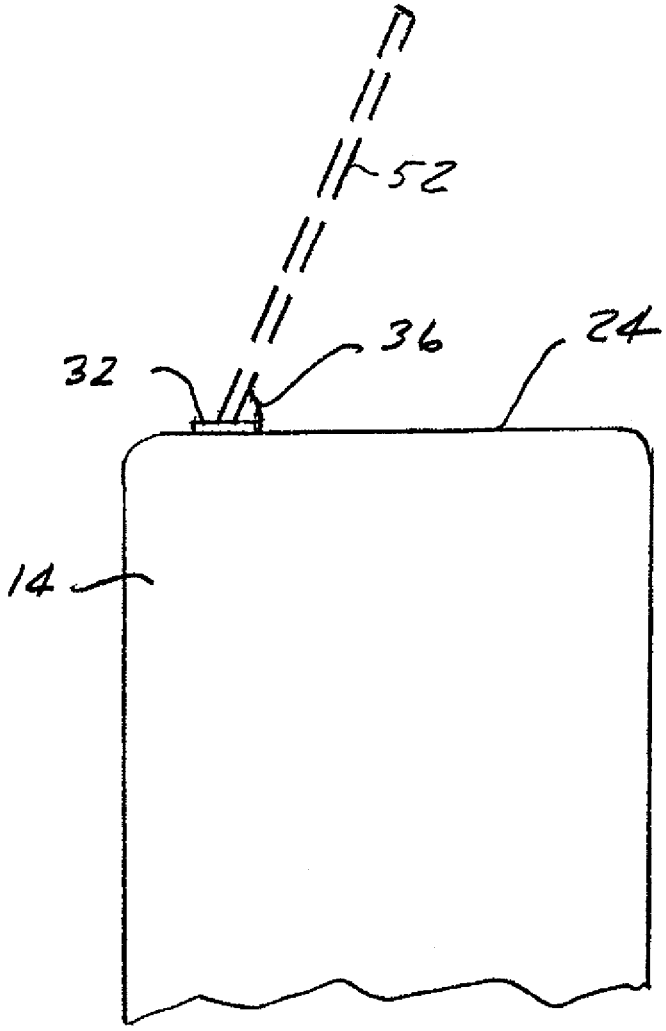
FIG. 9 is a schematic end view of the luggage with the receptacle shown supporting a tablet computer, with the tablet computer shown in broken lines.

As is best shown in FIGS. 3-9, the receptacle 32 is a unitary member which includes a flange 34 portion, a support portion 36, a pair of end wall portions 38, 40 and a curved bottom portion 42. The support portion 36 includes a pair of rubber or elastomeric bumper pads 44, 46. The front portion 48 of the flange 34 includes a generally U-shaped depression 50. The depression 50 provides access to the lower portion of a tablet computer 52 which is mounted in the receptacle cavity 54 as shown in FIGS. 2, 8 and 9.

Figure 4:
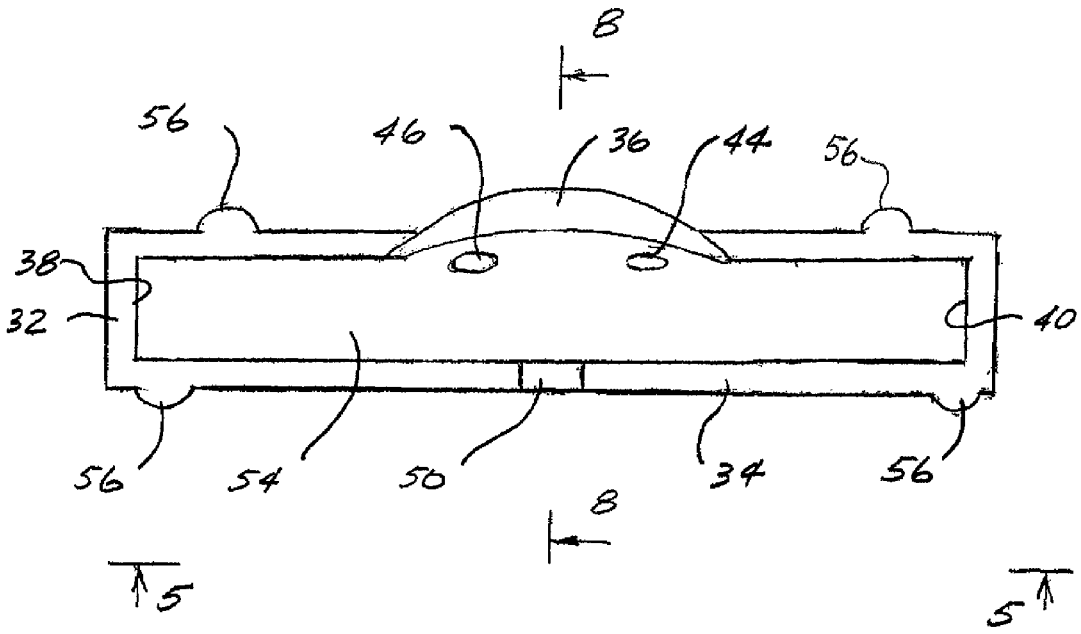
FIG. 4 is a top plan view of the receptacle of FIG. 1.
Figure 5:
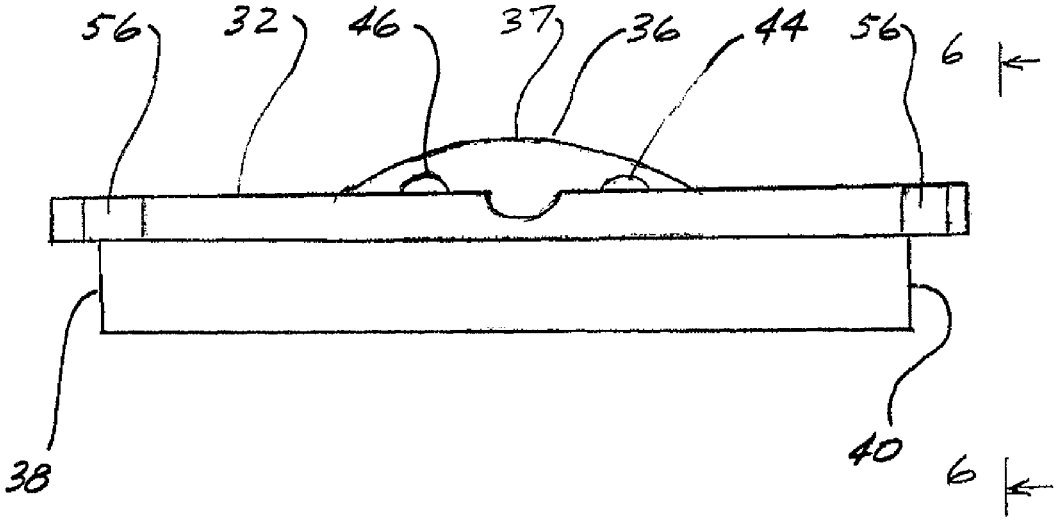
FIG. 5 is a front elevation view of the receptacle taken along the line 5-5 of FIG. 4.

With reference to FIGS. 4, 5 and 7, there is shown the mounting boss portions 56. FIG. 4 is a top plan view of the receptacle 32. FIG. 4 shows the integral backrest or support portion 36, the flange 34, and the boss portions 56 which are used to secure the receptacle 32 to the top panel portion 24 of the luggage assembly 12. FIG. 4 shows the receptacle 32 formed as an integral member.

FIG. 6 shows an end view taken along the line 6-6 of FIG. 5. FIG. 5 shows the backrest or support portion 36 of the receptacle 32 formed at an angle relative to the plane of the flange 34 of the receptacle 32. The angle has been designated in FIG. 6 by the letter A. The preferred range of the angle A is in the order of 95 degrees to 120 degrees. The back 35 and the top 37 of the support portion 36 are curved.

FIG. 7 is similar to FIG. 6 showing the receptacle 32 mounted on the top panel 24 portion of the luggage assembly 12. The receptacle 32 is attached to the panel portion 24 by means of screws 58.

As shown in FIG. 7, the receptacle 32 projects into a slot 60 formed in the panel portion 24.

The curved back 35 and the curved top 37 of the support portion 36 enable the luggage with support receptacle 10 to be handled in the normal manner using conventional luggage handbag equipment without danger of snagging or catching.

FIG. 8 is a cross-sectional view taken along the line 8-8 of FIG. 4. FIG. 4 includes a tablet computer 52 which is shown in broken lines. The lower portion 62 of the tablet computer 52 rests or lodges in the smoothing curved bottom portion 64 of the receptacle 32. The back of the tablet computer 52 rests against the rubber bumpers 44, 46 thereby providing a convenient angle for operating the tablet computer 52. The receptacle cavity 54 is proportioned to accept tablet computers of various thicknesses and to accept tablet computers in both portrait and landscape orientations. FIG. 8 shows the typical structure of the receptacle 32 which includes a generally vertical portion 66, a generally horizontal portion 68 and a downwardly directed portion 70.

FIG. 9 is a schematic side view of the luggage with support receptacle 10 showing a tablet computer 52 mounted in the receptacle 32.

Figure 10:
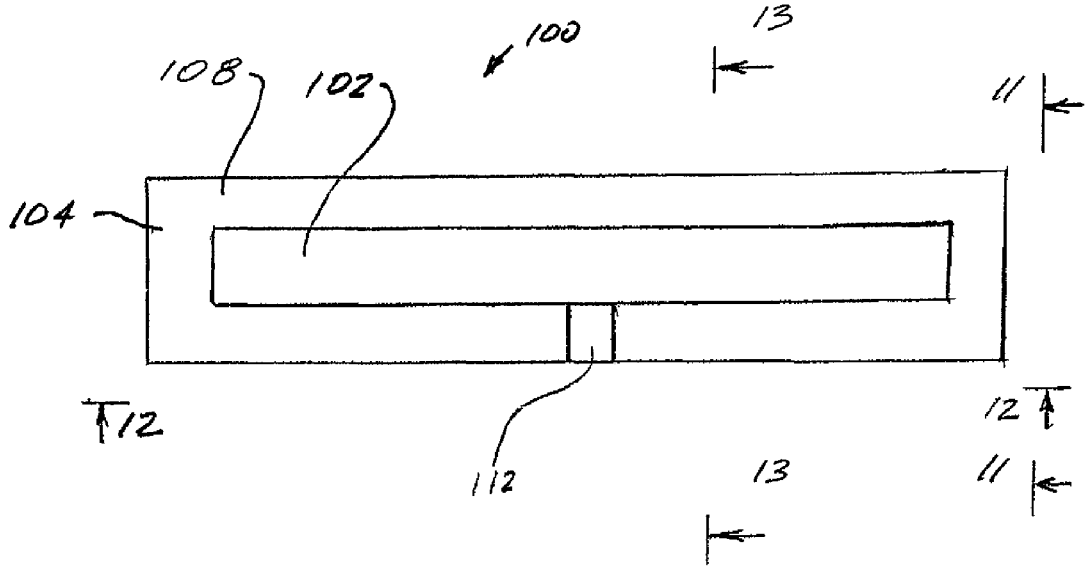
FIG. 10 is a top plan view of an alternate embodiment of the receptacle which incorporates a door panel.
Figure 11:
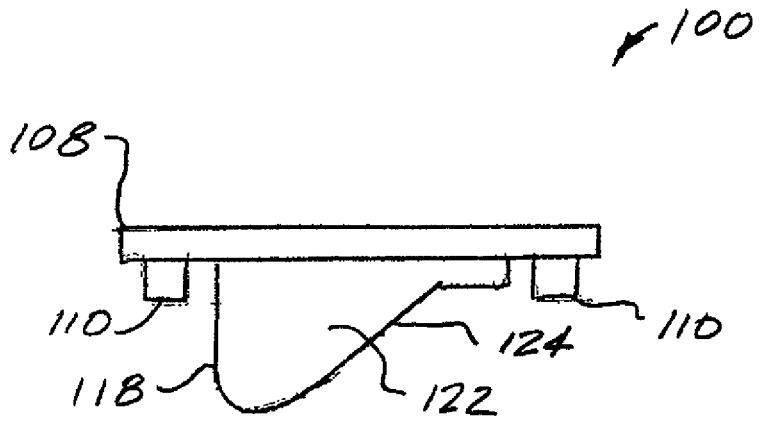
FIG. 11 is a side elevation view taken along the line 11-11 of FIG. 10.
Figure 12:
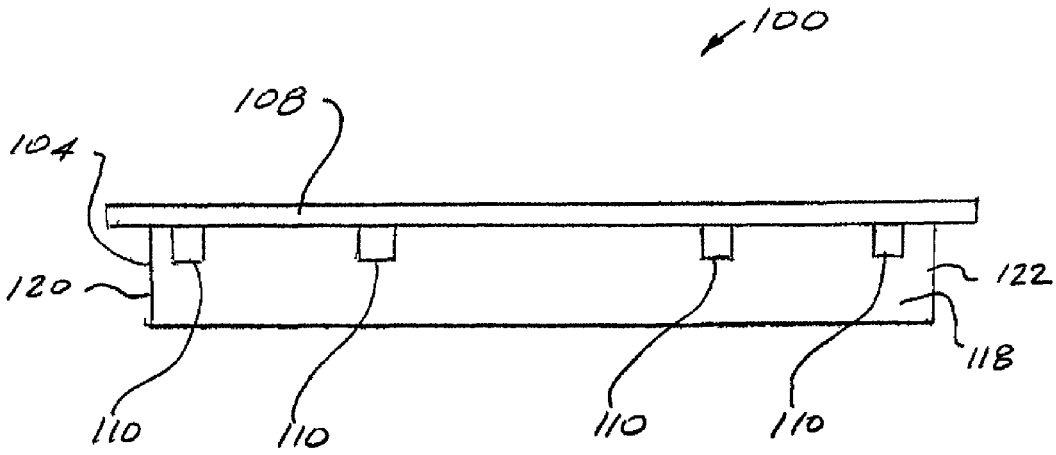
FIG. 12 is a front elevation view taken along the line 12-12 of FIG. 10.
Figure 13:
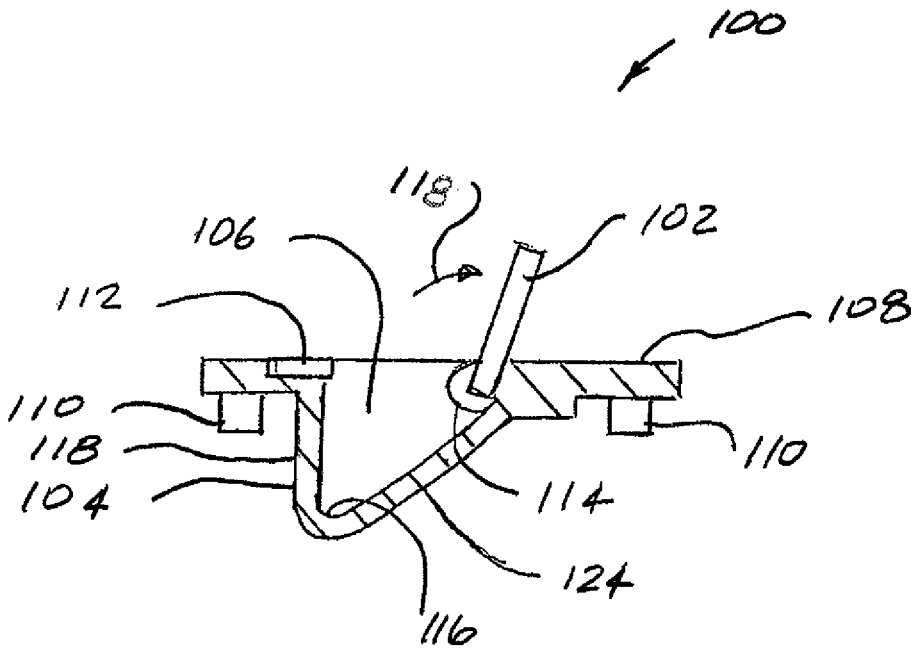
FIG. 13 is a cross-sectional view taken along the line 13-13 of FIG. 10 showing the door panel in the open position.

FIGS. 10-13 show an alternate embodiment of the invention 100. FIG. 10 is a top plan view of the alternate embodiment of the invention 100 which incorporates a door panel 102. The embodiment 100 includes a receptacle 104 which defines a receptacle cavity 106 which is best shown in FIG. 13.

FIG. 11 is a side view taken along the line 11-11 of FIG. 10. FIG. 11 shows the door in the closed position. FIG. 11 shows the flange portion 108.

FIG. 12 is front elevation view taken along the line 12-12 of FIG. 10. FIG. 12 shows boss portions 110 which receive mounting screws for mounting the receptacle 104 on the top panel 24 of luggage in the manner illustrated and described previously in connection with FIG. 7.

FIG. 13 is a cross-sectional view taken along the line 13-13 of FIG. 10. FIG. 13 on the door panel 102 in the open position ready to support a tablet computer 52.

The door panel 102 is typically held in a closed position as shown in FIGS. 10-12 by a latch 112 which may be a spring operated latch. The latch 112 is conventional in nature and need not be further described. The door panel 102 is pivotally mounted on the receptacle 102 by spring mounted pivots 114. When the latch 112 is operated by a user the door panel 102 moves in the direction 118 shown in FIG. 13. In the closed position, the door panel 102 and the flange portion 108 present a generally smooth flat surface. In the open position the door panel 102 provides support for the tablet computer.

As is best shown in FIG. 13 the bottom 116 of the receptacle cavity 106 is curved in the manner previously described in connection with the primary embodiment 10. The receptacle 104 is able to accept and support all types of tablet computers 52.

The receptacle cavity 106 is defined by wall portions 118, 120, 122, 124 and as described above is generally similar to the receptacle cavity 54 illustrated in FIG. 8.

The receptacle has been shown and described as a unitary member which is attached to the upper portion of the luggage. It is within the scope of the present invention to integrally mold or form the receptacle as part of the upper portion of the luggage.

In another embodiment of the invention, which has not been illustrated, the receptacle may serve as a support for a set of slides which allow the tablet computer to slide into the luggage for storage in a manner similar to a desk drawer sliding into a desk.

The foregoing specific embodiments of the present invention as set forth in the specification are for illustrative purposes only. Various deviations and modifications may be made within the spirit and scope of this invention without departing from a main theme thereof.

What is claimed is:

1. Luggage comprising:

a luggage assembly comprising a pair of side panel portions, a front panel portion, a rear panel portion opposite the front panel portion, a bottom panel portion, and a top panel portion connecting the side panel, front panel and rear panel portions;

a telescoping handle projecting upward from the top panel portion; and a receptacle mounted on the top panel portion and disposed apart from the telescoping handle, the receptacle comprising a receptacle cavity, a flange portion defining a mouth of the receptacle cavity and having a front portion including a generally U-shaped depression, a support portion projecting upwardly above the flange portion and above the top panel portion, a pair of end wall portions and a curved bottom portion; the support portion formed with a curved back and a curved top, the support portion being arranged at an angle of 95 to 120 degrees relative to a plane of the flange portion.

2. The luggage according to claim 1 further comprising rubber or elastomeric bumper pads arranged on the support portion.

3. The luggage according to claim 2 further comprising a plurality of boss portions securing the receptacle to the top panel portion.

* * * * *